US005455661A

United States Patent [19]

Yoshida et al.

[11] Patent Number: 5,455,661

[45] Date of Patent: Oct. 3, 1995

[54] CHARGING DEVICE FOR AN IMAGE FORMING APPARATUS

[75] Inventors: Minoru Yoshida; Takeshi Watanabe, both of Tokyo; Shigeru Fujiwara; Masashi Takahashi, both of Kanagawa, all of Japan

[73] Assignee: Kabushiki Kaisha Toshiba, Kawasaki, Japan

[21] Appl. No.: 207,044

[22] Filed: Mar. 8, 1994

[30] Foreign Application Priority Data

Mar. 25, 1993 [JP] Japan ..... 5-066586

[51] Int. Cl.[6] ..... G03G 15/02

[52] U.S. Cl. ..... 355/219; 355/277

[58] Field of Search ..... 355/219, 215, 355/271, 273, 277, 296, 298, 303, 274

[56] References Cited

U.S. PATENT DOCUMENTS

| | | | |
|---|---|---|---|
| 4,339,195 | 7/1982 | Gabelman | 355/219 |
| 4,457,615 | 7/1984 | Seanor | 355/219 |
| 4,761,709 | 8/1988 | Ewing et al. | 355/219 |
| 4,769,671 | 9/1988 | Koff | 355/271 X |
| 4,922,299 | 5/1990 | Uchimoto et al. | 355/219 |
| 4,998,143 | 3/1991 | Kumasaka et al. | 355/271 |
| 5,101,238 | 3/1992 | Creveling et al. | 355/271 |
| 5,196,892 | 3/1993 | Mitsuaki | 355/219 X |
| 5,227,851 | 7/1993 | Yoshida et al. | 355/271 |
| 5,233,393 | 8/1993 | Yoshida et al. | 355/271 |
| 5,233,394 | 8/1993 | Fujita et al. | 355/271 |
| 5,249,022 | 9/1993 | Watanabe et al. | 355/271 |
| 5,260,746 | 11/1993 | Yoshida et al. | 355/245 |

FOREIGN PATENT DOCUMENTS

| | | |
|---|---|---|
| 63-210862 | 9/1988 | Japan . |
| 1-267667 | 10/1989 | Japan . |
| 4-62665 | 10/1992 | Japan . |

OTHER PUBLICATIONS

Patent Abstracts of Japan, vol. 7, No. 109 (P–196) (1254) 12 May 1983 and JP 58–30777.

Patent Abstracts of Japan, vol. 10, No. 157 (P–464) (2213) 6 Jun. 1986 and JP 61–9677.

Patent Abstracts of Japan, vol. 9, No. 250 (P–394) (1973) 8 Oct. 1985 and JP 60–101576.

Patent Abstracts of Japan, vol. 13, No. 108 (P–843) (3456) 15 Mar. 1989 and JP 63–286879.

Patent Abstracts of Japan, vol. 14, No. 426 (P–1105) (4369) 13 Sep. 1990 and JP 2–166487.

Patent Abstracts of Japan, vol. 10, No. 93 (P–445) (2150) 10 Apr. 1986 and JP 60–229079.

Patent Abstracts of Japan, vol. 13, No. 1 (P–808) 6 Jan. 1989 and JP 63–210862.

*Primary Examiner*—Sandra L. Brase
*Attorney, Agent, or Firm*—Foley & Lardner

[57] ABSTRACT

A charging device in an image forming apparatus is provided with an image carrier such as a photosensitive drum or image forming medium on which an electrostatic latent image is developed. The charging device has a brush roller for charging the carrier. The roller brush is rotatably mounted and formed with inclined fibers planted on a shaft, the roller brush satisfying the following formulas:

$$L_2 \leqq L_1 - 0.5$$

$$L_2 \geqq L_1 \times 0.5$$

wherein $L_1$ represents a length of fibers and $L_2$ represents a thickness of the brush. The charging device further has means for removing the charges from the surface of the brush roller and means for cleaning an area where the charges are removed by the charge removing means.

15 Claims, 7 Drawing Sheets

CHARGING DEVICE FOR AN IMAGE FORMING APPARATUS

BACKGROUND OF THE INVENTION

1. Field of the Invention

The invention relates to a charging device for an image forming apparatus, which charges an image carrier such as a photo-sensitive drum or pape, and more particularly to a charging roller contacting to the image carrier.

2. Description of the Related Art

In electrostatic recording or electrophotographic recording, it is known that a corona charger is used for charging a photo-sensitive drum or for transferring an image formed on the photo-sensitive drum to a recording paper. In recent years, since the problems have risen that corona charging produces ozone which is harmful to human bodies and that actions for safety must be taken because the corona charger needs a high voltage power supply, a charging apparatus without using the corona charger is desired. By way of an example of charging without the corona charger, Japanese Patent Disclosure (kokai) No. 210862/88 discloses a brush charging roller and Japanese Patent Disclosure No. 267667/89 (kokai) discloses a contact charging method for charging a photo-sensitive drum with a biased charging roller contacting to the drum surface.

However, since, this contact charging method tends to make the drum surface non-uniformly charged, fogging or non-uniform shading would appear on developed images. A reason why the drum surface is not uniformly charged is as pointed out, because the resistance of the charging roller is not appropriate. Although a typical electronic photo-copying apparatus comprises a cleaner for cleaning the surface of the photo-sensitive drum after developing, toner particles, paper, and fine particles such as silica contained in the toner (collectively referred to as toner particles) are not completely removed and left on the drum surface, whereby these particles may adhere to the charging roller to cause so-called filming phenomena that the surface of the roller is covered with the particles. Owing to the filming phenomena, the surface resistance of the roller is changed. The filming phenomena is remarkable in a charging roller of a solid roller type. On the other hand, in the case of a charging roller of a brush roller type, although there are advantages that the brush roller is inexpensive compared with the solid roller and high accuracy is not required during mounting, non-uniform charging would happen owing to the construction of and the method of fabricating the brush, and lines or marks would appear in half tone images.

SUMMARY OF THE INVENTION

An object of the present invention is to provide a charging apparatus for an image forming apparatus comprising a charging roller which prevents non-uniform charging.

Another object of the invention is to provide an improved charging apparatus for an image forming apparatus.

According to the present invention there is provided a charging device for an image forming apparatus, the device is provided with an image carrier such as a photosensitive drum or an image forming medium on which an electrostatic latent image is developed. The charging device has a brush roller for charging the carrier. The roller brush is rotatably mounted and formed with inclined fibers planted on, the roller brush satisfying the following formulas:

$$L_2 \leqq L_1 - 0.5$$

$$L_2 \geqq L_1 \times 0.5$$

wherein $L_1$ represents a length of fibers and $L_2$ represents a thickness of the brush. The charging device further has means for removing the charges from the surface of the brush roller and means for cleaning an area where the charges are removed by the charge removing means.

DETAILED DESCRIPTION OF THE PREFERRED EMBODIMENTS

Figure 1:
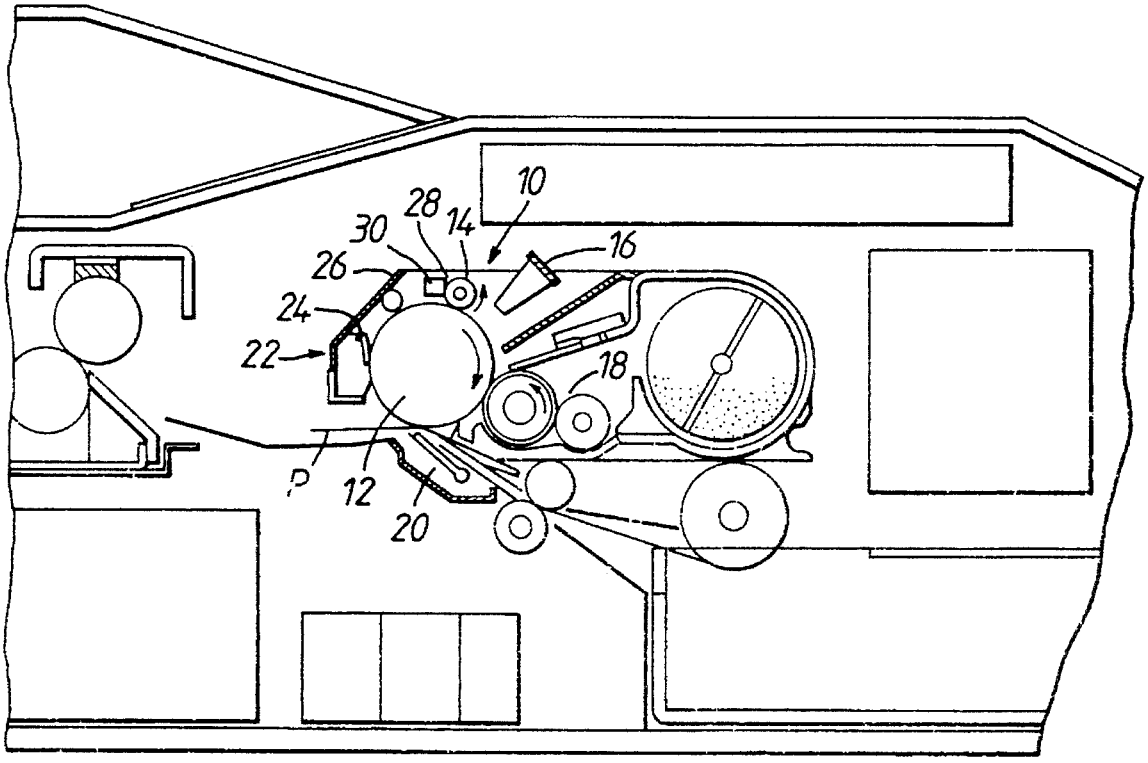
FIG. 1 is a sectional view of an image forming apparatus which incorporates a charging device of a first embodiment according to the present invention.

FIG. 1 shows an image forming apparatus 100 which incorporates one embodiment of a charging device 10 according to the present invention. The charging device 10 has a charging roller 14 so designed to contact the surface of a photo-sensitive drum 12 and rotate. High voltage required for uniformly charging the surface of the photo-sensitive drum 12 at −500 v is supplied to the charging roller 14 from a high voltage power supply (not shown) during copying. An exposure device 16 irradiates light to the photo-sensitive drum 12. An electrostatic latent image is formed on the photo-sensitive drum 12 in accordance with the exposure. A developing means 18 develops the electrostatic latent image, thereby to form a toner image on the photo-sensitive drum 12. A transferring means 20 transfers the toner image onto a sheet of paper P. A cleaner 22 has a blade 24 for removing from the photo-sensitive drum 12 residual toners which are left on the drum 12 because all of the toners have not been completely transferred. A de-energizing lamp 26 is positioned to be opposed to the photo-sensitive drum 12 and irradiates the drum 12, thereby to eliminate the residual charges on the drum 12.

Figure 2A:
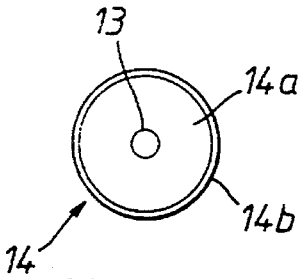
FIGS. 2(*a*) and (*b*) are views showing the construction of charging rollers.
Figure 2B:
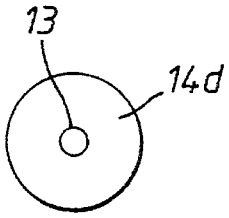

A conductive sheet 28 contacting the charging roller 14 is grounded via the predetermined resistance in the charging apparatus 10. Since the conductive sheet 28 serves not only for removing the charges of the charging roller 14 but also for removing adhesions to the roller surface, it may also be referred to as cleaning and charge-eliminating means. The charging roller 14, as shown in FIG. 2(*a*), is of two-layer construction consisting of an elastic layer 14*a* and a surface layer 14*b*. The elastic layer 14*a* is formed of a conductive urethane layer which is made of urethane rubber with hardness 35 degree, and the urethane rubber has a fixed resistance of $10^5$ Ω.cm around a shaft 13 having a diameter of 6 mm. On the other hand, the surface layer 14*b* is formed by applying a conductive urethane paint having a fixed resistance of $10^5$ Ω.cm and having the hardness 45 degree on the elastic layer 14*a* at a thickness of 40 μm. The hardness of the charging roller 14 should be within the range from 30 to 70 degrees (JIS-A). If the hardness is smaller, the problem occurs that the roller is deformed due to permanent distortion, and if the hardness is larger, it is difficult to secure a sufficient charged nip. The range of hardness mentioned above is applicable as long as the photo-sensitive drum 12 having a diameter of 30 to 50 mm is charged by the charging roller 12 having a diameter of 10 to 20 mm. Note that, if the surface roughness of the charging roller 14 is not less than 10 μm, such a state of the roller surface causes non-uniform charging, so that non-uniform charging influences the quality of the images and hinders cleaning by means of the conductive sheet 28. A container 110 is arranged close to the conductive sheet 28, which accumulates adhesions removed from the photo-sensitive drum 12 therein.

Figure 3:
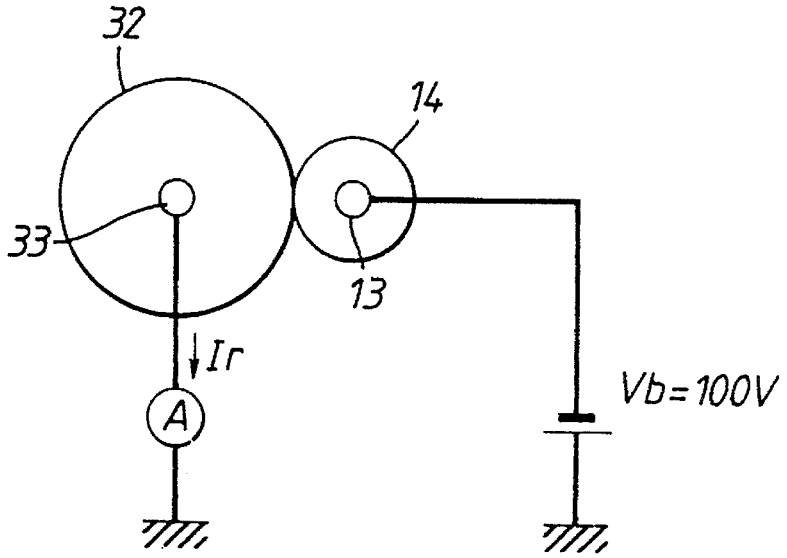
FIG. 3 is a view illustrating a method of measuring the resistance of the charging roller.

The charging roller 14 stably charges the photo-sensitive drum 12, and in order not to damage the drum 12, the fixed resistance R of the roller 14 is selected to be $10^3$ to $10^8$ Ω. The resistance R is obtained, as shown in FIG. 3, by applying a voltage of 100 v to the shaft 13 of the charging roller 14 which contacts an aluminum tube, measuring a current value Ir when the roller 14 rotates under substantially actual conditions, and calculating R=100/Ir (Ω).

Figure 4:
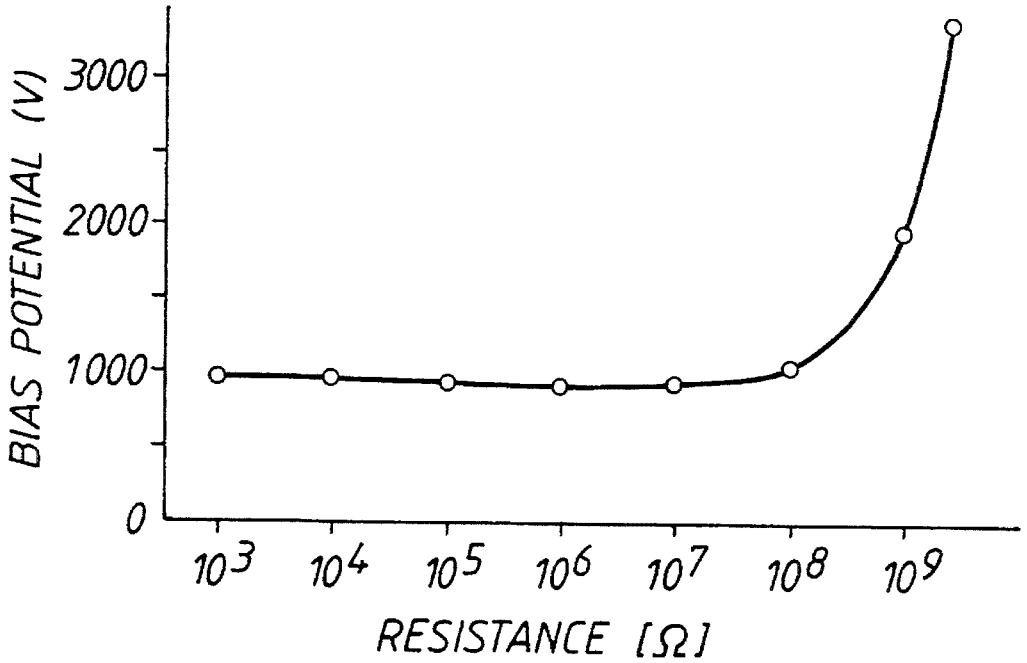
FIG. 4 is a graph showing the relationship between bias potential and the resistance of the charging roller.
Figure 5A:
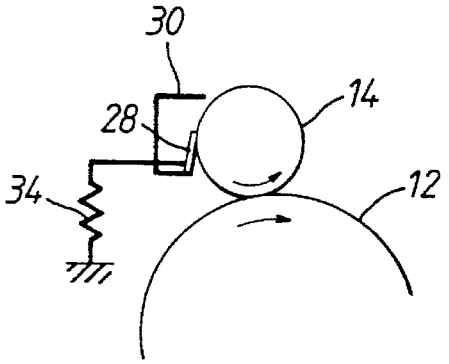
FIGS. 5(*a*) to (*e*) are views each illustrating an embodiment of the charging device.
Figure 5B:
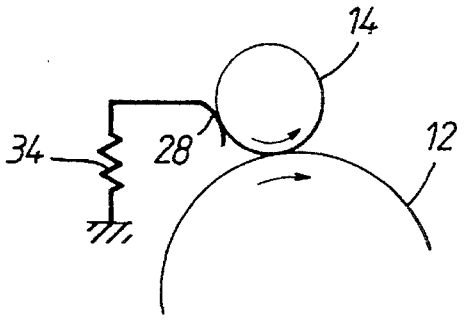
Figure 5C:
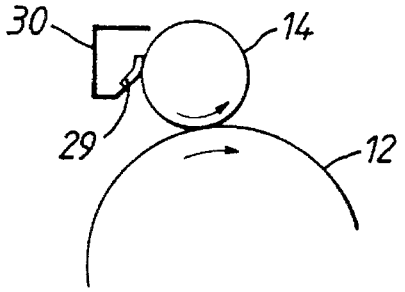
Figure 5D:
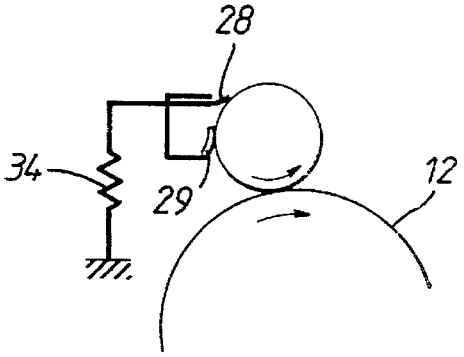
Figure 5E:
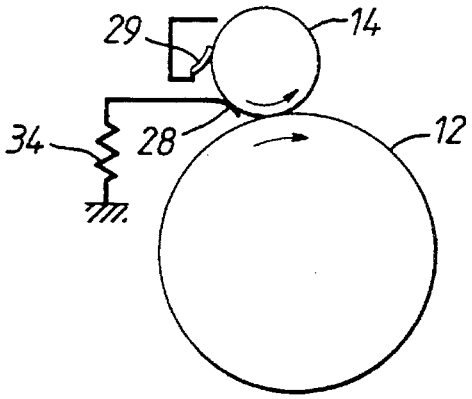

FIG. 4 shows the relationship between the fixed resistance R of the charging roller 14 and the applied bias for charging the surface of the photo-sensitive drum 12 with −500 v. It is understood from the graph that, if the fixed resistance is excessively high, the applied bias required for charging the drum 12 with −500 v is increased. When the applied bias is increased, sparks are locally generated on the roller surface and cause non-uniform charging, so that non-uniformity appears in half tone images. To the contrary, if the fixed resistance is excessively low, since the current is concentrated on fine pinhole portions scattered over the photo-sensitive drum 12, the drum is damaged, so that images are produced with black points being scattered. Therefore, the appropriate value of the fixed resistance R is $10^3$ to $10^8$ Ω. Note that, although the above charging roller 14 has the two-layer construction, even if the conditions on the hardness, the fixed resistance and the surface roughness described above are satisfied, the charging roller 14 may have single-layer construction, or may have more than three-layer construction.

FIG. 5(*a*) shows detailed construction of the charging device 10, in which the blade 28 as cleaning means having a vapor deposited polyester layer on an aluminum body is grounded via a resistance 34. Then, the blade 28 cleans the charging roller 14, whereby the surface charges of the roller 14 flow to the ground, preventing filming. A container 30 is detachably mounted for exchange when the toner particles removed from the surface of the charging roller 14 reach a predetermined amount.

Figure 6:
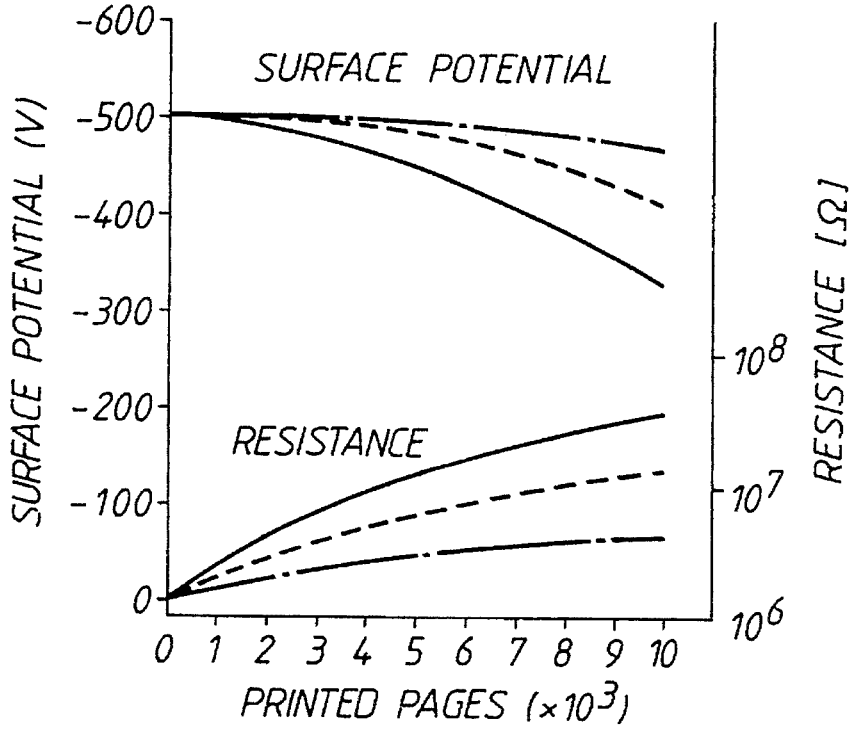
FIG. 6 is a graph showing the relationship among the surface potential of the charging roller, the resistance and the number of printed pages.

A printing test was made using the electronic photo-copying apparatus which incorporates the charging device 10. In order to charge the surface of the photo-sensitive drum 12 with −500 v, a constant voltage of 1000 v was given to the charging roller 14, and the charging roller 14 having a fixed resistance R of $2\times10^6$ Ω was used for the test. In FIG. 6, changes in the surface potential of the photo-sensitive drum 12 and the fixed resistance R of three types of the charging roller described bellow are shown in dotted lines. The fixed resistance R of the charging roller 14 after printing 10,000 pages was $4\times10^6$ Ω and the reduction of the surface potential of the photo-sensitive drum was about 30 v. Neither fogging nor lines in half tones appeared after printing 10,000 pages.

To confirm the action and effect of the above charging device 10 (type A), a printing test was also made by using an electronic photo-copying apparatus which incorporating a conventional charging device without the cleaning means and the container (type C), and by using an electronic photo-copying apparatus which incorporating a charging device shown in FIG. 5(*c*) in which a blade formed of a conductive urethane sheet contacts the charging roller (type B). Table 1 shows results of type B and type C together with results of type A.

TABLE 1

| Number of | Type A | | Type B | | Type C | |
|---|---|---|---|---|---|---|
| pages printed ($\times 10^3$) | Fogging | Non-uniformity in half tone | Fogging | Non-uniformity in half tone | Fogging | Non-uniformity in half tone |
| 0 | O | O | O | O | O | O |
| 1 | O | O | O | O | O | O |
| 2 | O | O | O | O | O | X(O) |
| 3 | O | O | O | O | O | X(X) |
| 4 | O | O | O | O | O | X(X) |
| 5 | O | O | O | O | O | X(X) |
| 6 | O | O | O | X(O) | O | X(X) |
| 7 | O | O | O | X(O) | O | X(X) |
| 8 | O | O | O | X(X) | O | X(X) |
| 9 | O | O | O | X(X) | X | X(X) |
| 10 | O | O | O | X(X) | X | X(X) |

O: No Problem
X: Fogging or non-uniformity is found

In the conventional charging device, the surface potential of the photo-sensitive drum was reduced to −350 v and the fixed resistance was increased to $4\times10^7$ Ω after 10,000 pages had been printed. Changes in the surface potential and the fixed resistance R are shown in dotted lines in FIG. 6. Non-uniformity of shading in half tones had already appeared at the point of time that 2,000 pages ware printed. Since the fixed resistance R in this time was about $8\times10^6$ Ω and the reduction of the surface potential of the photo-sensitive drum was about 20 v, filming was caused only locally. Even if thin filming was locally produced, the photo-sensitive drum 12 is charged without fail. For this reason, non-uniform charging can be restrained to a certain extent. However, since a discharge field of the charging roller is weakened if the charges continues being accumulated in the area where the filming exists, non-uniform charging is caused. Thus, fogging appeared after 9,000 papas had been printed. When the construction of the charging device is modified as in the charging device shown in FIG. 5(*b*) in which the conductive urethane sheet 28 is grounded via the resistance 34 and the sheet 28 contacts the charging roller 14, since the charges on the surface of the charging roller 14 are eliminated, non-uniformity shading in half tones is prevented until 3,000 pages are printed. (The results of the modified construction are shown within brackets.)

The charging device of type B has a blade 29 formed of urethane which contacts the charging roller 14 for cleaning its surface (this blade 29 is not grounded), and the device has a container 30 for receiving the toner particles which are removed by means of the blade 29. Using this charging apparatus, fogging did not appear until the total number of the printed pages reached 10,000. Changes in the surface potential of the photo-sensitive drum and the fixed resistance R are shown as dotted lines in FIG. 6. The resistance was $1\times10^7$ Ω when 10,000 pages had been printed and a rise in the resistance was considerably restrained compared with the case of using the conventional charger, while the surface potential of the photo-sensitive drum 12 was reduced to −420 v. Non-uniformity of shading in half tones appeared after the total number of the printed pages exceeded 6,000, but since the blade 29 cleans the surface of the charging roller, such a charging device can be obtained where non-uniformity of shading will not appear up to 5,000 pages. Note that, if the construction of this charging device is modified to that of the blade 29 being grounded, non-uniformity of shading in half tones can be prevented up to 7,000 pages. (The results of the modified construction are shown within brackets.)

A charging device shown in FIG. 5(*d*) is provided with cleaning means consisting of the blade 29 which has a vapor deposited polyester layer on an aluminum body and which contacts the charging roller, and with charge-eliminating means in which the conductive urethane sheet 28 contacts the conductive surface of the charging roller 14 to ground via the resistance 34. A container for receiving the toner particles which are removed from the charging roller 14 may be located below the cleaning means to ensure the collection of the toner particles after they are removed and fall. It is ascertained that filming and a rise in the resistance of the charging roller are much restrained by cleaning the surface of the roller after de-energization than by cleaning and de-energization at the same time. By de-energization of the roller surface by means of the blade having a vapor deposited polyester layer, not only the roller surface is de-energized and the roller surface is prevented from being charged, but also contaminants such as toner particles are easy to remove. Then, it is thought that the efficiency of cleaning is improved. For example, in a charging device in which charge-eliminating member is arranged downstream of a cleaning member as in FIG. 5(*e*), slightly better results were obtained as for changes in the resistance of the roller surface compared with the charging device of FIG. 5(*c*), while non-uniformity of shading appeared around 9,000 pages.

In case that the charging roller 14 rotates along with the rotation of the photo-sensitive drum 12 by a frictional force caused by contacting the drum 12, as shown in FIGS. 5(*a*) to (*e*), if the de-energizing means, the cleaning means, or the cleaning means serving also as de-energizing means is forced strongly against the charging roller 12, the charging roller 14 slips from the photo-sensitive drum 12, so that no smooth rotation can be obtained, causing non-uniformity charging. Preventing non-uniform charging by smoothly rotating the charging roller 14 and the photo-sensitive drum 12 requires that driving torque needed for rotating the charging roller 14 which is forced against and contacts the charge-eliminating means, the cleaning means, or the cleaning means serving also as de-energizing means be smaller than rotating torque required for rotating the charging roller 14 without these means along with the photo-sensitive drum 12. Note that the charging roller 14 may be driven by means of trains of gears for longer life of the roller 14 and improved cleaning.

Figure 7:
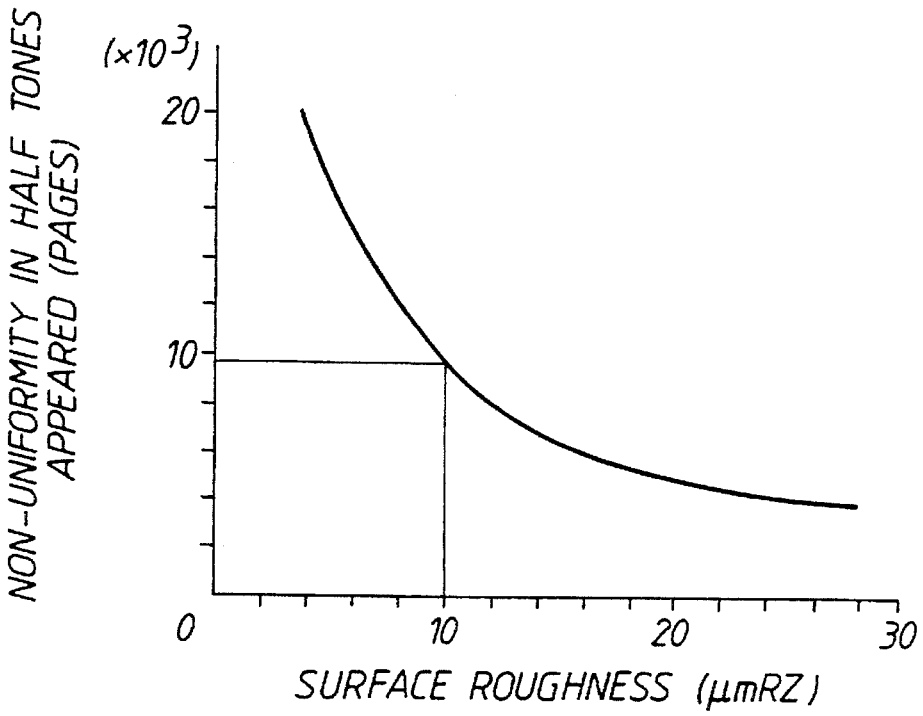
FIG. 7 is a graph showing the relationship between the surface roughness of the charging roller and the number of pages where non-uniformity appears in half tones.

The graph of FIG. 7 shows how non-uniformity in half tones appears depending on the surface roughness of the charging roller 14. It shows that, if the surface roughness of the charging roller 14 is not greater than 10 μm (Rz), non-uniformity in half tones will not appear when the total number of the printed pages is within 10,000. Non-uniformity in half tones mentioned here indicates non-uniformity due to filming and it was evaluated ignoring non-uniform charging previously mentioned (which appears as white lines or black lines in the image). This is because if the surface roughness is not less than 10 μm (Rz), cleaning is difficult to perform and filming cannot be prevented.

As described above, by using the charging device which has means for cleaning the surface of the charging roller or de-energizing thereon, non-uniform charging can be prevented and the images can be obtained without fogging or non-uniformity of shading in half tones.

Although, in the above embodiment, the charging device using a solid type charging roller has been described, a charging device using a transferring brush of a second embodiment according to the invention will be described below, the same reference numbers indicating the same elements in the above embodiment.

Figure 8:
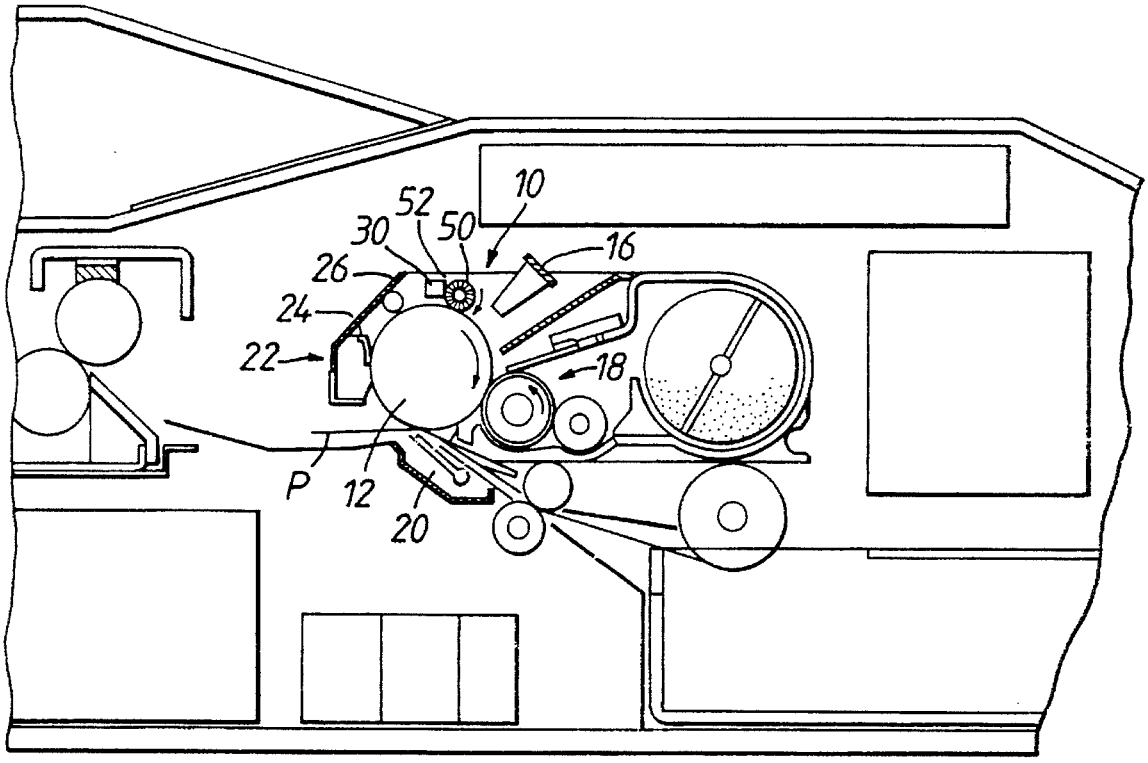
FIG. 8 is a sectional view of an image forming apparatus which incorporates a charging device of a second embodiment according to the invention.

FIG. 8 shows an image forming apparatus 100 which incorporates a charging device 10 having a charging brush 50. The charging device 10 comprises of the changing brush 50 so designed to contact the surface of a photo-sensitive drum 12 and to rotate, and a metal grid 52, i.e., a body formed of metallic plates being arranged in a grid-like form which serves as cleaning means for cleaning the brush 50 which contacts the and face of the brush 50 and serves as de-energizing means for de-energizing the brush 50 (see FIG. 12(*a*)). The metal grid 52 is grounded via a resistor (not shown) to be zero potential. Exposure means 16 irradiates light to the photo-sensitive drum 12. An electrostatic image is formed on the photo-sensitive drum 12 in accordance with the exposure. A developing means 18 develops the electrostatic image to form a toner image on the photo-sensitive drum 12. A transferring means 20 transfers the toner image to a sheet of paper P. A cleaner 22 has a blade 24 for removing residual toners which are left on the photo-sensitive drum 12 because all of the toners have not been completely transferred to the paper P. A de-energizing lamp 26 is provided to be opposed to the photo-sensitive drum 12, which de-energizes the drum 12 by applying light thereon.

Figure 9:
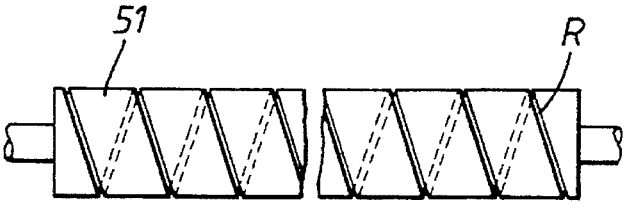
FIG. 9 is a front view of a charging brush.
Figure 10A:
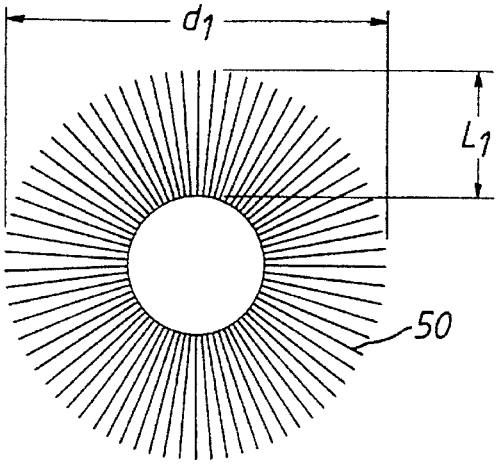
FIG. 10(*a*) is a schematic front view of a brush whose fibers are planted straight, and FIGS. 10(*a*) and (*c*) are schematic front views of a brush whose fibers are planted inclinedly.
Figure 10B:
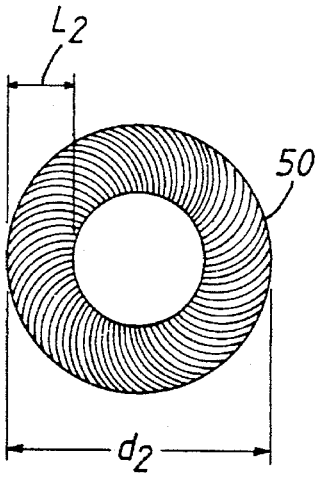
Figure 10C:
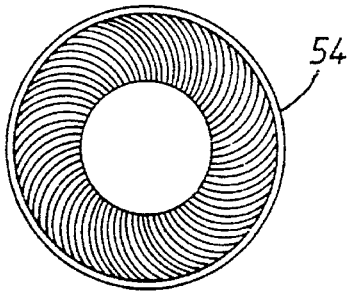

The outside diameter of the transferring brush 14 is 14 mm and the fixed resistance is $3\times10^5$ Ω. The charging brush 50 hardly cause non-uniform charging which is brought about because it non-uniformly contacts the photo-sensitive drum 12, compared with a rubber roller or the like. However, since the charging brush 50 is manufactured as shown in FIG. 9 by the manner that brush fibers are bundled in suitable density on a strap-like or strip-like base cloth 51 and this is wound around a base in a spiral form, in half tones non-uniformity is easy to appear at joint portions in the brush produced because the base cloth is wound around the base in a spiral form (portions R in FIG. 9, and hereinafter referred to as marks of joint portions). Also, in two-component development using a toner and carrier, there is the tendency that lines will appear as if drawn by a paint brush in the direction that the brush moves on the produced images. For this reason, the charging brush, as shown in FIG. 10(*b*), in which straight brush fibers are planted obliquely on the base cloth so that the brush matches the rotating direction, is employed for the charging brush 50. The brush fibers 50 planted straight on the base cloth are inclined by rotating the brush 50 while heating the brush 50 inside a cylindrical tube 54. Providing that the length of the brush fibers of the brush roller is L1 and the thickness of the brush after its fibers are inclined is L2, the brush used here satisfies the following expression (the way to follow the expression will be described later):

$$L_2 \leqq L_1 - 0.5\ (mm)$$

$$L_2 \geqq L_1 \times 0.5$$

It is known that the lower the density of the brush fibers, more lines appears, but there is a limitation in the density of the fibers due to difficulty in fabrication and the density of the fibers employed is in the range from 20,000 fibers/inch$^2$ to 200,000 fibers/inch$^2$. The thinner the thickness of the brush fiber, less non-uniform charging appears. But if the thickness is too small, the brush is forced against the photo-sensitive drum for a long period, so that the fibers lie down or fold. Therefore, the appropriate density is 2 to 10 D (denier). As the set brush resistance is higher, charging properties become more unstable. Therefore, local charging faults are caused and non-uniformity appears in the image. The fixed resistance is preferably not more than $10^8$ Ω. But taking the prevention of damage to the photo-sensitive drum 12 into account, the range of the fixed resistance from $10^3$ to $10^8$ Ω is preferred.

Figure 11:
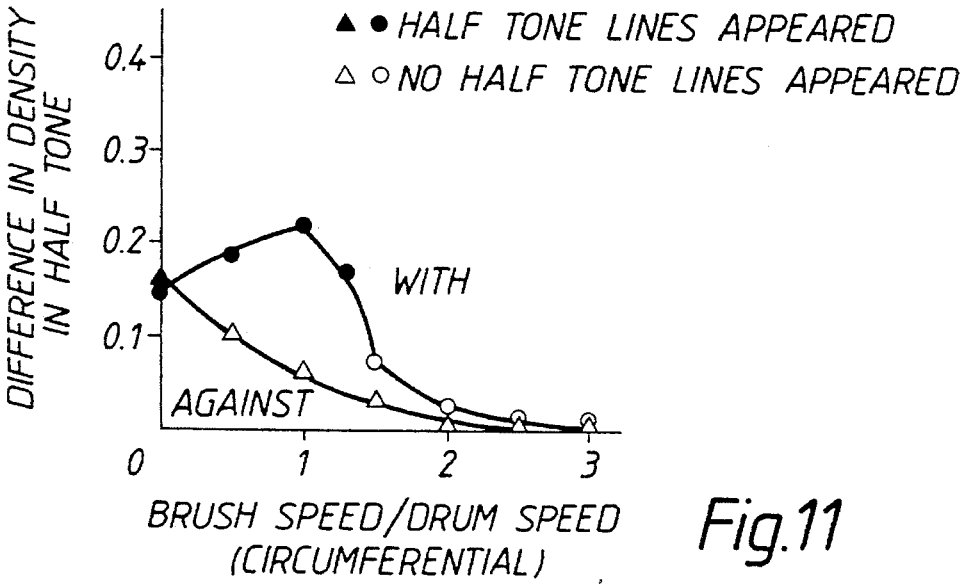
FIG. 11 is a graph showing whether marks of joint portions in the brush appear or not and whether lines appears in half tones or not.

When the relative circumferential speed of rotation of the charging brush 50 is too slow with respect to the circumferential speed of the photo-sensitive drum, marks of point portions as mentioned above or lines in the images tend to stand out. As the graph in FIG. 11 shows, when the charging brush 50 rotates in the same direction as the photo-sensitive drum 12 (the relative speed of the transferring brush 50 with respect to the photo-sensitive drum 12 is low), the circumferential speed of the rotation of the brush 50 is set to be one and a half or more times as fast as the circumferential speed of the drum 12. When the brush 50 rotates in the reverse direction of the drum 12 (the relative speed of the brush 50 with respect to the drum 12 is high), the speed of the rotation of the brush 50 is set to be once or more times as fast as the circumferential speed of the drum 12. In this way, a difference in density in half tones which are caused owing to the joint portions in the brush becomes 0.1 or less, then it being possible to obtain an image of high quality. As shown in Table 2, when the charging brush 50 is excessively pressed into the photo-sensitive drum 12, lines tend to appear. However, when the amount that the brush 50 is pressed into the drum 12 is too small, and when the amount is set to 0.5 mm or less, the brush 50 only insufficiently contacts the drum 12, so that non-uniform charging will be brought about. Therefore, the appropriate length is about 0.5 to 2.5 mm.

TABLE 2

| Length of | WITH twice | | AGAINST one and a half times | |
|---|---|---|---|---|
| insertion | Lines | Non-uniformity | Lines | Non-uniformity |
| 0.2 | None | Found | None | Found |
| 0.4 | None | Found | None | None |
| 0.5 | None | None | None | None |
| 0.8 | None | None | None | None |
| 1.0 | None | None | None | None |
| 1.5 | None | None | None | None |
| 2.0 | None | None | None | None |
| 2.5 | None | None | None | None |
| 3.0 | Found | None | Found | Found |

A printing test was made by using an image forming apparatus 100 incorporating the charging device 10 having the charging brush 50. When a successive printing test was performed by giving a voltage of 1000 v to the charging brush 50 in order to charge the surface of the photo-sensitive drum 12 with −500 v, neither lines nor non-uniformity appeared even after the number of the printed pages had exceeded 2,000. When the printing test was performed with the metal grid 52 detached and by using the image forming apparatus incorporating the charging device 10 consisting of the charging brush 50 only, lines in half tones strikingly appeared when only about 10,000 pages had been printed. This is because there was no de-energizing nor cleaning effects because of lack of the metal grid 54 and as a result, toner particles adhered to the tip of the charging brush 50 to impair the discharging performance of the brush. However, this has proven that, even if the charging device having the charging brush 50 whose fibers are inclined is used without the metal grid 54 which serves both as de-energizing means and as cleaning means, there is no practical problem similar to the case of the charging device of the first embodiment as long as it is used to print about 10,000 pages.

Figure 12A:
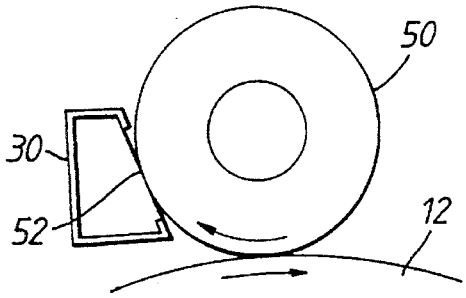
FIGS. 12(*a*) and (*b*) are views illustrating positions where cleaning means is located.
Figure 12B:
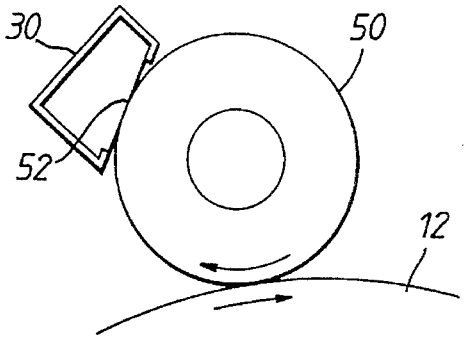

In the case that the metal grid 54 is also used, it is desirable that the position that the cleaning means is mounted on is located as shown in FIG. 12(*a*) such that the toner particles removed by the charging brush 50 do not fall onto the brush 50 again, i.e., located downstream going in the direction of the charging brush 50. The position shown in FIG. 12(*b*) is not preferable because the removed toner particles fall onto the charging brush 50 again.

Although the charging apparatus for charging the photo-sensitive drum has been described in the respective embodiments above, the invention can be applied to a transferring device for transferring the toner image to an image receiving medium such us a sheet of paper P.

Figure 13:
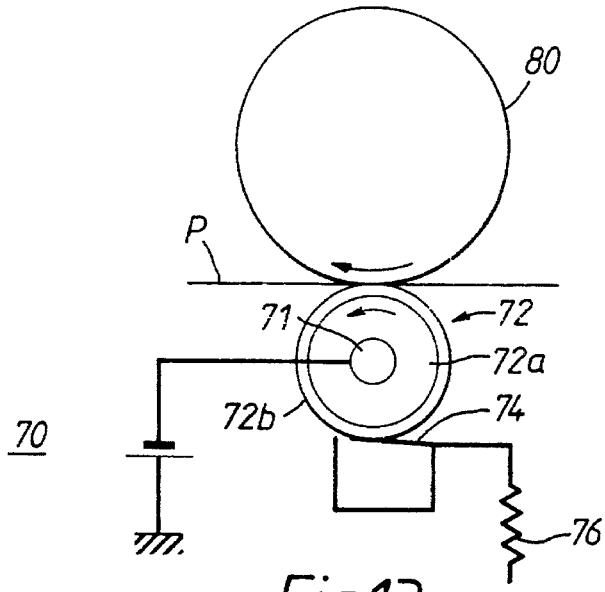
FIG. 13 is a view showing a transferring device of a third embodiment according to the invention.

FIG. 13 shows a transferring device 70 of a third embodiment according to the invention. The transferring device 70 has a transferring roller 72 for charging the paper P, which is constructed by fitting an elastic body 72*a* onto a conductive shaft 71 and covering an outer surface of the elastic body with a highly smooth surface layer 72*b*. Further, the transferring device 70 is provided with a conductive rubber blade 74 for cleaning the surface of the transferring roller 72, which is grounded via the roller 72. The blade 74 is grounded via a resistor 76 of $10^5$ Ω. Taking into account conditions for efficient cleaning, the surface roughness of the surface layer 72*b* of the transferring roller 72 is 10 μm (Rz) or less and its hardness is set to be within the range from 30 to 70 degree in JIS-A. In a reversed developing type laser printer using an organic photo-conductor type photo-sensitive drum 12, charges having the (+) polarity are produced on the photo-sensitive drum 12, while charges having the (−) polarity are applied to the paper P from a transferring bias power supply (not shown) through the transferring roller 72. A container 78 receives toner particles which are removed from the surface of the transferring roller 72 as the roller 72 rotates. A paper supply roller 80 supplies the paper P in cooperation with the transferring roller 72.

When printing by the laser printer employing the charging apparatus 70, transferring was continued successfully without filming up to 20,000 pages.

To confirm the action and effect of the transferring apparatus 70 described above (type A), a printing test was made by using a laser printer incorporating the transferring device whose blade 74 was not grounded (type B), and by using a laser printer incorporating a conventional transferring device having neither the blade 74 nor the container 78 and performing no cleaning function (type C). Table 3 shows results of the printing test for types B and C as well as type A.

TABLE 3

| Number of pages printed | Type A | Type B | Type C |
|---|---|---|---|
| 2500 | ○ | ○ | ○ |
| 5000 | ○ | ○ | ○ |
| 7500 | ○ | ○ | X |
| 10000 | ○ | ○ | X |
| 15000 | ○ | X | X |
| 20000 | ○ | X | X |

○: No transfer faults
X: Transfer faults

In the transferring device of type B, no filming appeared around 10,000 printed pages, and transfer faults due to filming were caused beyond 10,000 pages. In the device of type C, since the transferring roller was not cleaned and and de-energization by the blade, filming appeared on the transferring roller around 5,000 pages, resulting in transfer faults. This would be because some residual toners adherent to white potential between paper sheets were moved onto the transferring roller and gradually accumulated thereon so as to cause filming.

Note that a metal grid being grounded as shown in FIG. 12(*a*) may be used in place of the blade 74 being grounded.

Although the above-mentioned transferring device of the third embodiment according to the invention uses a solid type transferring roller, a brush roller whose fibers are inclined may be used as the transferring brush roller as in the case of the charging roller for charging the photo-sensitive drum.

Next, a brush roller whose fibers are inclined for use in the transferring device, as a fourth embodiment of the invention, will be described.

Since the brush roller whose fibers are inclined for use in the transferring device has the same form as the brush roller shown in FIG. 10(*b*) has, the fourth embodiment will be described referring to FIGS. 10(*a*) and (*c*). The brush roller whose fibers are inclined for use in the transferring device prevents the brush fibers from folding or being damaged, and also is effective in improving the image quality at an early stage where marks of joint portions or lines would appear. The brush also satisfies the following expression where the length of the brush fibers is L1 and the thickness of the brush after its fibers are inclined is L2:

$$L_2 \leqq L_1 - 0.5 \ (mm)$$

$$L_2 \geqq L_1 \times 0.5$$

The expression is obtained by evaluating whether or not lines or marks of joint portions will appear when the brush having an outer diameter (d2) of 10 to 16 mm and the brush having an outer diameter (d2) of 8 to 12 mm are used as the transferring brush. Results of the evaluation on each brush are shown in Tables 4(*a*) and 4(*b*).

TABLE 4 (a)

| Outer diameter d2 (mm) | Marks of joint portions | Damage of brush | Comprehensive evaluation |
|---|---|---|---|
| 10 | Not found | Found | NG |
| 11 | Not found | Not found | OK |
| 12 | Not found | Not found | OK |
| 13 | Not found | Not found | OK |
| 14 | Not found | Not found | OK |
| 15 | Little found | Not found | OK |
| 15.5 | Found | Not found | NG |
| 16 | Remarkably found | Not found | NG |

TABLE 4 (b)

| Outer diameter d2 (mm) | Marks of joint portions | Damage of brush | Comprehensive evaluation |
|---|---|---|---|
| 8 | Not found | Found | NG |
| 8.5 | Not found | Found | NG |
| 9 | Not found | Not found | OK |
| 10 | Not found | Not found | OK |
| 11 | Little found | Not found | OK |
| 11.5 | Found | Not found | NG |
| 12 | Remarkably found | Not found | NG |

These brush 50 are manufactured as follows. First, a plurality of two types of brushes is made: one type is a brush whose fibers formed of rayon of 6 D (denier) are straight and are radiately bundled in a density of 120,000 fibers/inch on a shaft having an outer diameter of 6 mm so that the brush has an outer diameter (d1) of 16 mm, and the other is a brush whose fibers formed of rayon of 5 D (denier) are straight and are radiately bundled in a density of 100,000 fibers/inch$^2$ on a shaft having an outer diameter of 6 mm so that the brush has an outer diameter (d1) of 12 mm. Then, these brushes whose fibers are straight are inserted into a plurality of cylindrical tubes 54 having different inner diameters, and the cylindrical tubes 54 are rotated while heating the insides thereof. In this way, a brush 50 whose fibers are inclined and whose outer diameter (d2) is 10 to 16 mm, or a brush 50 whose fibers are inclined and whose outer diameter (d2) is 8 to 12 mm is obtained.

Since L1 is represented by {outer diameter of a brush of straight fibers (d1)−diameter of a shaft}/2 and L2 is represented by {outer diameter of brush of inclined fibers (d2)−diameter of a shaft}/2, when fibers are planted on a shaft having an outer diameter of 6 mm to make a brush of straight fibers whose outer diameter is 16 mm and finally a brush of inclined fibers having an outer diameter of 11 mm is obtained, a length of the brush fibers is 5 mm, and then, a radial thickness of the brush is 2.5 mm. That is, L1–L2 equals 2.5 and L1/L2 equals 0.5, thus obtaining the brush of inclined fibers within the range mentioned above. Note that, when a difference between d1 and d2 is more than 5 mm in the brush of inclined fibers, it is required to lower the density of the fibers. In this case, however, since there is the tendency that lines will appear and the brush fibers will fold or be damaged during manufacturing or using the brush, such a brush is not preferable.

Figure 14A:
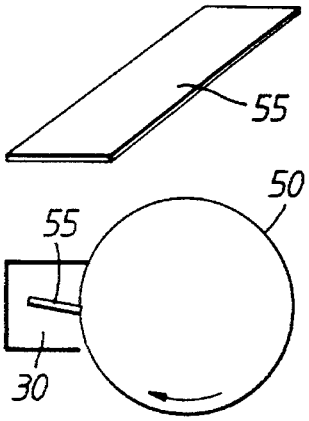
FIGS. 14(*a*), (*b*), and (*c*) are views showing modifications of the cleaning means.
Figure 14B:
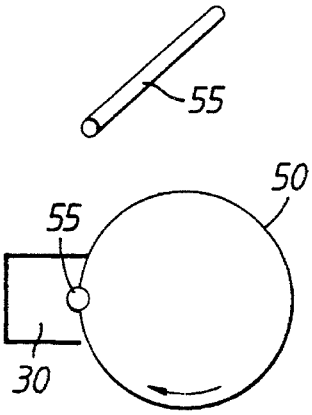
Figure 14C:
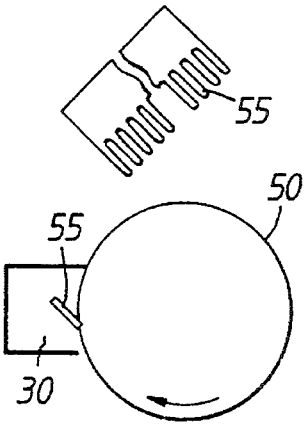

When the brush of inclined fibers 50 is used for a transferring roller during successive copying together with the metal grid shown in FIG. 4(*a*), unlike the brush of straight fibers, the metal grid will not damage the brush fibers, allowing use for a long period. Also, in place of the metal grid, a resin grid 55 having conductivity in a form as shown in FIGS. 14(*a*) to 14(*c*) may be used. Although the above expression applies to the transferring brush, it is also applicable to the charging brush of the photo-sensitive drum, so the description was omitted in the latter case.

Hitherto, the charging roller in the charging device and the transferring device has been described in the above embodiments. Further, the invention can be also applied to the charging apparatus and the transferring apparatus using a belt type charging apparatus.

What is claimed is:

1. A charging device for charging electrostatic charges on a surface of an image carrier comprising:

means rotatably mounted to and contacting the image carrier for charging the image carrier, the charging means including a roller brush having inclined planted fibers, the roller brush satisfying the following formulas:

$$L_2 \leqq L_1 - 0.5\ mm$$

$$L_2 \geqq L_1 \times 0.5$$

wherein $L_1$ represents a length of the fibers and $L_2$ represents a thickness of the brush;

means contacting the charging means for removing the charges from the surface of the charging means; and means contacting the charging means for cleaning an area where the charges are removed by the charge removing means.

2. A charging device according to claim 1, wherein the removing means has a conductive sheet contacting to the charging means and a resistor connected to the conductive sheet and grounded.

3. A charging device according to claim 1, wherein the cleaning means is provided upstream to the removing means with respect to the rotational direction of the charging means.

4. A charging device for charging electrostatic charges on a surface of an image carrier comprising:

means rotatably mounted to and contacting the image carrier for charging the image carrier, the charging means including a roller brush having inclined fibers planted on a shaft, the roller brush satisfying the following formulas:

$$L_2 \leqq L_1 - 0.5\ mm$$

$$L_2 \geqq L_1 \times 0.5$$

wherein $L_1$ represents a length of the fibers and $L_2$ represents a thickness of the brush; and means contacting the charging means for removing the charges from the surface of the charging means and for cleaning an area where the charges are removed.

5. A charging device according to claim 4, wherein the removing and cleaning means has a conductive sheet contacting to the charging means and a resistor connected to the conductive sheet and grounded.

6. A charging device according to claim 4 further comprising:

means contacting to the brush roller for removing the charges from the surface of the roller brush; and means contacting to the roller brush for cleaning an area where the charges are removed by the charge removing means.

7. A charging device according to claim 6 further comprising:

means detachably and adjacently disposed to the brush roller for collecting toner particles removed from the brush roller.

8. A charging device according to claim 7, wherein the removing means has a conductive sheet contacting to the blush roller and a resistor connected to the conductive sheet and grounded.

9. A charging device according to claim 8, wherein the cleaning means is provided upstream to the removing means with respect to the rotational direction of the brush roller.

10. A charging device according to claim 4, wherein the image carrier is formed with a photosensitive drum and the photosensitive drum is rotated with the brush roller, the circumferential speed of the brush roller being set to one and half times or more higher than that of the photosensitive drum.

11. A charging device according to claim 4, wherein the image carrier is formed with a photosensitive drum and the photosensitive drum is rotated against the brush roller, the circumferential speed of the brush roller being set to one time or more higher than that of the photosensitive drum.

12. A charging device according to claim 4, wherein the brush roller is pressed-in the image carrier, the press-in amount of the length being set to about 0.5 to 2.5 mm.

13. A transferring device for transferring a developed image on an image carrier to an image forming medium comprising:

means rotatably mounted to and contacting the image forming medium for charging the image forming medium, the charging means including a roller brush having inclined fibers planted on a shaft, the roller brush satisfying the following formulas:

$$L_2 \leqq L_1 - 0.5\ mm$$

$$L_2 \geqq L_1 \times 0.5$$

wherein $L_1$ represents a length of the fibers and $L_2$ represents a thickness of the brush;

means contacting the charging means for removing the charges from the surface of the charging means; and means contacting the charging means for cleaning an area where the charges are removed by the charge removing means.

14. A transferring device according to claim 13, wherein the removing means has a conductive sheet contacting to the charging means and a resistor connected to the conductive sheet and grounded.

15. A transferring device according to claim 13 wherein the cleaning means is provided upstream to the removing means with respect to the rotational direction of the charging means.

* * * * *